United States Patent [19]

Sorensen

[11] 4,315,353

[45] Feb. 16, 1982

[54] CASKET VAULT

[76] Inventor: Lloyd L. Sorensen, 256 W. 300 South, Malad, Id. 83252

[21] Appl. No.: 135,329

[22] Filed: Mar. 31, 1980

[51] Int. Cl.[3] ..... A61G 17/00

[52] U.S. Cl. ..... 27/2; 27/7

[58] Field of Search ..... 27/2, 7, 35; 52/128, 52/138–142

[56] References Cited

U.S. PATENT DOCUMENTS

| | | | |
|---|---|---|---|
| 1,506,279 | 8/1924 | Torrence | 27/35 |
| 1,871,453 | 8/1932 | Cobb | 27/35 |
| 1,973,947 | 9/1934 | Enderle | 27/35 |
| 2,030,588 | 2/1936 | Hedeen et al. | 27/35 |
| 2,940,156 | 6/1960 | Cook | 27/7 X |
| 3,208,188 | 9/1965 | Fulton et al. | 27/35 X |
| 3,868,799 | 3/1975 | Hayward | 27/35 |
| 4,154,031 | 5/1979 | Williamson, Jr. | 27/35 |

*Primary Examiner*—John D. Yasko

*Attorney, Agent, or Firm*—Terry M. Crellin; B. Deon Criddle

[57] ABSTRACT

A lightweight burial vault made entirely of plastic with appropriate stabilizers and additives which can be sealed so as to be moisture proof and has sufficient strength and durability to withstand the loading forces of the fill earth, comprises a base unit forming the floor of the vault and a dome-like cover having a concave top integrally molded to the upstanding side and end walls thereof. A system of ribs is formed integrally to the outside of the cover, and means are provided for sealing the cover to the base unit. The base unit may have a plurality of spaced apart troughs extending thereacross to collect fluids inside the vault.

5 Claims, 5 Drawing Figures

CASKET VAULT

BACKGROUND OF THE INVENTION

1. Field:

This invention relates to burial vaults and in particular to relatively lightweight burial vaults made of plastic with appropriate stabilizers and additives.

2. Prior Art:

Burial vaults of various constructions have been utilized including vaults made of wood, concrete, and metal. These vaults are of such weight or bulk to require large, specialized equipment for transportation and installation. Vaults made of plastic material have been proposed. See, for example, U.S. Pat. Nos. 2,508,319 and 3,159,901. However, the vaults of the latter type have not been used extensively due to inadequate strength and water resistance.

3. Objectives:

A principal objective of the present invention is to provide an inexpensive, lightweight burial vault made entirely of a plastic material and which can be sealed to be moisture proof and will withstand the pressure of the fill earth in the grave to prevent distortion of the vault which would otherwise disrupt the moisture proof seal. An additional objective is to provide such a burial vault having trough means in the floor thereof for collection of fluids resulting from decomposition of the body buried therein and to maintain the fluids out of contact with the casket or coffin in the vault.

SUMMARY OF THE INVENTION

The above objectives are achieved in accordance with the present invention by providing an improved, sturdy, lightweight, sealed, burial vault made entirely of a plastic material. The terms "plastic material" and "plastic" as used throughout the specification and claims are meant to include any polymeric material including but not limited to addition polymers such as vinyl polymers, condensation polymers such as polyesters and polyamides, thermosetting polymers, and fiber reinforced polymers such as that commonly called fiberglass.

The burial vault comprises a substantially rectangular base unit which forms the floor of the vault. A dome-like cover portion is adapted to be sealed to the base unit. For sealing purposes, the base unit is provided with an outwardly extending ledge around its perimeter and the lower edges of the cover portion are provided with a flange which is adapted to seat against the ledge on the base unit. A waterproof gasket is preferably positioned between the flange and the ledge and fastening means are provided for securely holding the flange and ledge together.

The dome-like cover portion has a concave top integrally formed to the upper edges of the upstanding side and end walls, with the side and end walls also being integrally formed together at their junctures. The cover portion is made by conventional molding and casting techniques. When using a thermoplastic material, the cover portion is advantageously formed by injection molding. In molding or casting the cover portion an elongate center rib is formed integrally to the surface of the cover. The elongate rib extends longitudinally along the longitudinal center line of the top of the cover and downwardly along the opposite end walls of the cover. A plurality of spaced cross ribs are also formed integrally to the surface of the cover, with the cross ribs extending upwardly along the side walls and then along the top of the cover to join the elongate rib. The elongate center rib and the cross ribs are formed mutually on either the inner surface or outer surface of the cover portion.

In a preferred embodiment of the invention, the base unit is provided with a plurality of spaced apart troughs formed integrally therein and extending thereacross. The troughs are advantageously oriented substantially normal to the longitudinal axis of the base unit. The troughs provide dimensional stability for the base unit and further function to collect fluids resulting from decomposition of the body which is interred in the vault. Deterioration of the coffin or casket in the vault is greatly reduced by collecting and maintaining the fluids separate and out of contact with the coffin or casket. The troughs also provide a clearance space for webbing used to lower the vault and casket into the grave.

Additional objectives and features of the invention will become apparent from the following detailed description, taken together with the accompanying drawings.

THE DRAWINGS

A preferred embodiment of the burial vault of this invention representing the best mode presently contemplated of carrying out the invention in actual practice is illustrated in the accompanying drawings, in which.

DETAILED DESCRIPTION OF THE ILLUSTRATED EMBODIMENT

In accordance with the invention, a sturdy, relatively lightweight, sealed burial vault is made entirely of a plastic material. The plastic vault provides for equivalent or increased protection and preservation of the casket or coffin placed therein in comparison to the commonly used cement vaults, and the plastic vault is more easily handled with less costly equipment and less personnel than the bulky and heavy cement vaults. The vault of the present invention is adapted to be sealed so as to form a completely waterproof vault, and the present vaults cost far less than sealed vaults used heretobefore.

Figure 1:
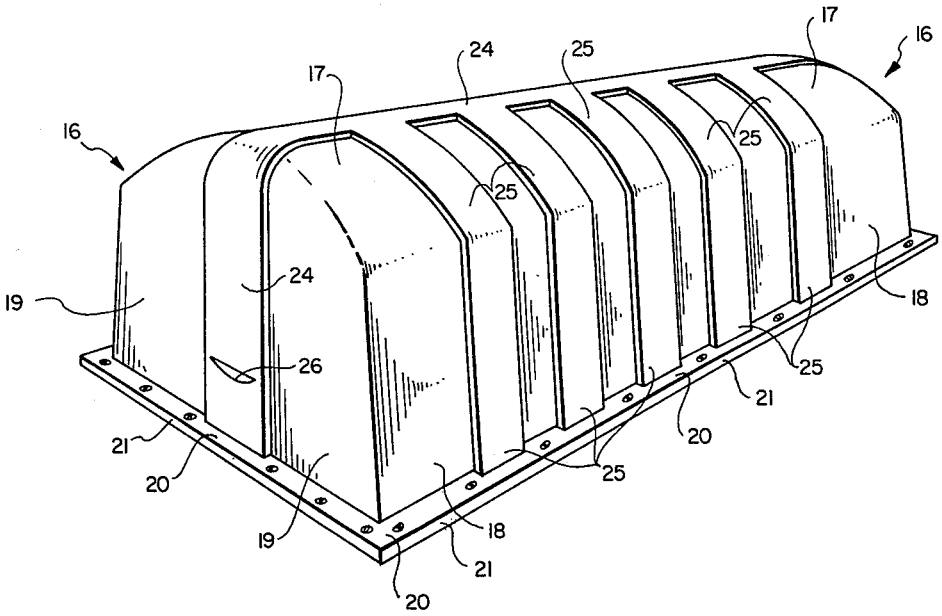
FIG. 1 is a perspective view of the burial vault showing the cover portion sealed to the base unit.
Figure 2:
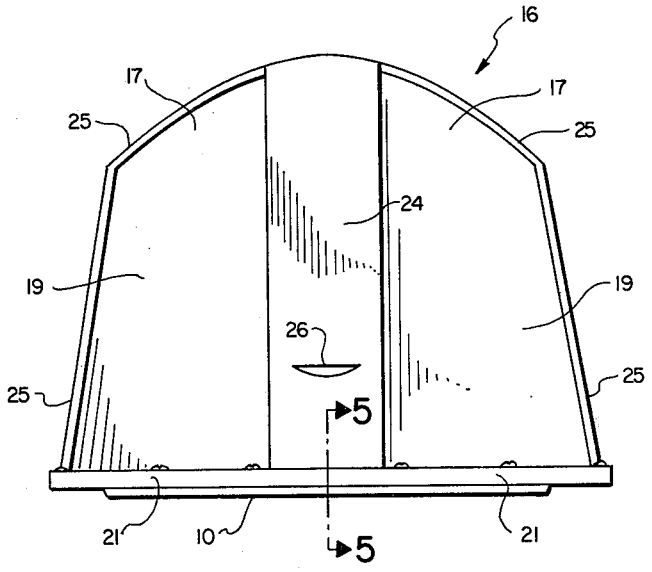
FIG. 2 is an end view of vault of FIG. 1.
Figure 3:
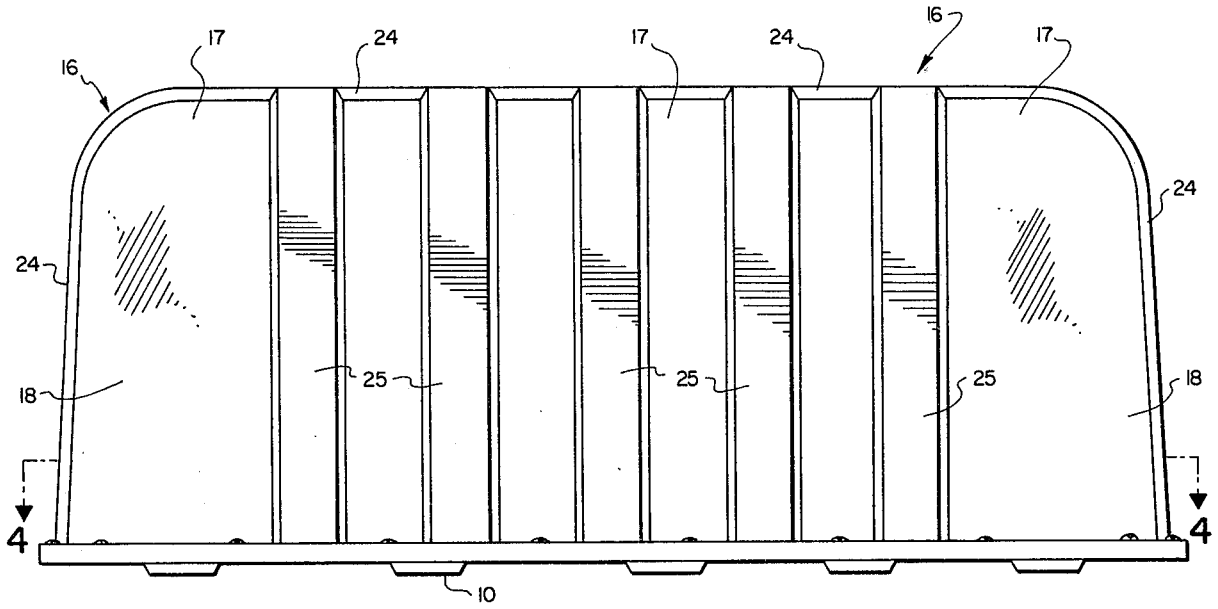
FIG. 3 is a side view of the vault of FIG. 1.
Figure 4:
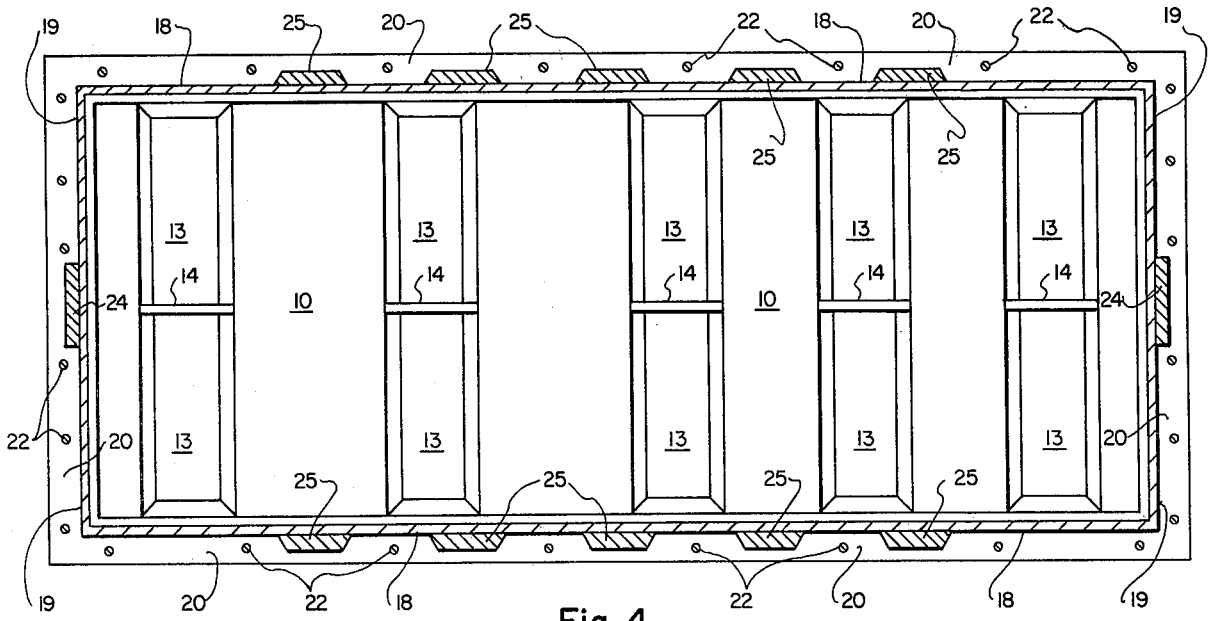
FIG. 4 is a horizontal section taken along line 4—4 of FIG. 3.
Figure 5:
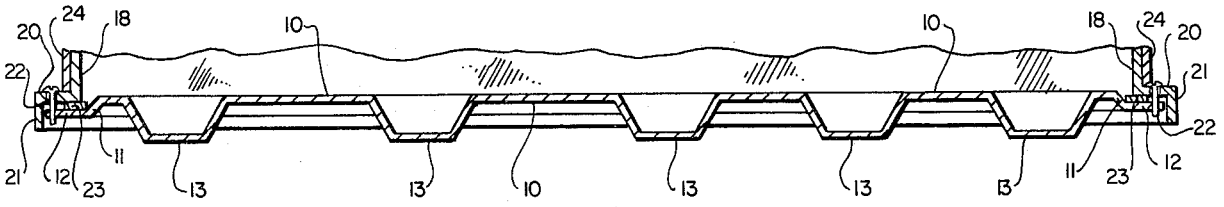
FIG. 5 is a partial verticle section taken on line 5—5 of FIG. 2.

Referring now to the drawings, the plastic vaults of this invention comprise a substantially rectangular base unit 10, best illustrated in FIGS. 4 and 5, which forms the floor of the vault. Preferably, the floor portion of base unit 10 has a downwardly slanting lip 11 circumscribing its perimeter as shown in FIG. 5. A ledge 12 extends outwardly from the lip 11, with the ledge 12 being in a plane parallel to the plane of the floor portion of base unit 10. The lip 11 and ledge 12 are formed integrally with the floor portion of base unit 10. The troughs 13 extend across the floor of the base unit 10 substantially normal to the longitudinal axis of the base unit 10. The troughs 13 are spaced apart along the longitudinal length of the base unit 10. The troughs 13 preferably have slanting side walls which are formed integrally with the floor portion of the base units. The side walls extend downwardly beyond the depth of the lip 11 at the perimeter of the base unit 10, so that the bottoms of the troughs 13 provide the support surface for the vault. For that purpose, the troughs 13 have flat bottoms which are formed integrally with the sidewalls thereof. End walls are provided for the troughs 13 so that the troughs 13 are open only to the upper side of the base unit 10. As illustrated, the troughs 13 can also be provided with a divider section 14 (see FIG. 4) extending thereacross near the longitudinal mid section of each trough, so as to divide each trough into two separate collection chambers.

The base unit 10 is preferably formed with the various portions thereof, i.e., the troughs, the floor portion, the lip 11, and ledge 12, having a substantially uniform thickness. A wall thickness of between about 1/16 inch and $\frac{1}{4}$ inch has been found to be advantageous, with a wall thickness of about $\frac{1}{8}$ inch being preferred. Wall thicknesses of less than about 1/16 inch do not provide sufficient strength, and wall thicknesses greater than about $\frac{1}{4}$ inch become uneconomical.

The trough formations 13 in the base unit 10 provide stability and strength as well as to function as collection chambers to collect fluids resulting from the decomposition of the body which is interred in the vault. The troughs 13 collect such fluids, and contact of the fluids with the casket or coffin is minimized. Destructive degradation of the casket or coffin is, thus, greatly decreased, and the integrity of the casket or coffin is maintained for a much longer time than if the fluids were not collected out of contact with the casket or coffin. The spacing of the troughs 13 is advantageously made to efficiently collect the fluids by providing a shorter spacing between troughs 13 at one end of the vault, with somewhat longer spacing between troughs 13 at the other end of the vault. When the body which is being interred is placed in the vault, the upper portion of the body is placed in the end of the vault having the shorter spacings between troughs 13. Thus, the main or upper portion of the torso of the body is placed over an area with an increased number of troughs and greater fluid collection capacity in comparison to the area beneath the lower portion of the torso. Conventionally, the vault is about 85 to 100 inches in length, and it has been found, as illustrated, that about 5 troughs 13 are sufficient, each trough 13 being about 2 to 4 inches wide at its bottom and 5 to 10 inches wide at its top. The end troughs 13 are spaced from their centers to the respective ends of the base unit 10 by about 6 to 12 inches. Center to center spacings between the next two troughs 13 at one end of the vault is preferably about twice the corresponding center to center spacings at the other end of the vault. As illustrated in FIGS. 4 and 5, the spacing between the first and second, and second and third troughs 13 from the left of the drawings is about twice the spacing between the first and second, and second and third troughs 13 from the right of the drawings. The troughs 13 also have a clearance between the ground and the base of the vault to allow webbing (which is used to lower the vault and casket to the bottom of the grave) to be easily removed from under the vault after it is in its final resting position at the bottom of the grave.

The vault further comprises a dome-like cover portion shown generally by the numeral 16. The cover 16 has a concave top 17 which in is integrally formed to the upper edges of the upstanding side and end walls 18 and 19, respectively. The side and end walls 18 and 19 are also integrally formed together at their respective junctions, i.e., their abutting edges. The wall thickness of the top 17, end walls 18, and side walls 19 of the cover 16 is generally between about 1/16 inch and $\frac{1}{4}$ inch, with a thickness of about $\frac{1}{8}$ inch being preferred. As with the base unit 10, a wall thickness of less than 1/16 inch generally has insufficient strength, and wall thicknesses greater than about $\frac{1}{4}$ inch are uneconomical.

An extra measure of moisture protection is provided for the casket by the effective air-lock produced by the dome-like portion. To enhance the effectiveness of the air-lock, the casket rests on the top landings of the troughs 10 which are elevated above the water tight seal which lies between the flange 20 and the ledge 12.

A flange 20 formed integrally to the bottom edge of the end walls 18 and side walls 19 extends around the perimeter of the cover portion 16. The flange 20 is adapted to mate with the ledge 12 on the base unit 10 when the dome-like cover portion 16 is positioned on the base unit 10. The flange 20 preferably has a lip 21 extending downwardly from the outer perimeter thereof. The lip 21 is adapted to cover the outer edges of the ledge 12 on the base unit 10 when the cover 16 is in position on the base unit. Means are provided for sealing the flange 20 on the cover portion 16 to the ledge 12 on the base unit 10. As illustrated, a plurality of spaced, threaded fasteners 22 fit through oversized holes in the flange 20 and are threaded into the ledge 12. A waterproof gasket 23 (FIG. 5) is advantageously positioned between the flange 20 and ledge 12.

An elongate rib 24 extends longitudinally along the longitudinal center line of the top 17 of the cover portion 16 and then downwardly along the opposite end walls 19. The rib 24 is formed integrally to the top 17 and end walls 19 of the cover 16. The rib 24 can project upwardly from the outer surfaces of the top 17 and end walls 19 as illustrated or inwardly from the inner surfaces of the top 17 and end walls 19. A plurality of spaced, cross ribs 25 extend upwardly along the side walls 18 and then along the top 17 to join the elongate rib 24. The cross ribs 25 are formed integrally to the side walls 18 and top 17 of the cover 16. In addition, the upper ends of the cross ribs 25 are integrally joined to the elongate rib 24. Thus, if the elongate rib 24 is positioned on the outer surfaces of the cover 16 as illustrated, the cross ribs 25 also project from the outer surface. If the elongate rib 24 is positioned on the inside surface of the cover 16, the cross ribs 25 would also project from the inside surface, so that the upper ends of the cross ribs 25 would join the elongate rib 24. The elongate rib 24 and cross ribs 25 provide strength and dimensional stability to the cover 16.

The elongate rib 24 has a width of about 5 to 10 inches, preferaably about 8 inches. The cross ribs have widths of from about 3 to 8 inches, preferably about 6 inches. At least about three sets of cross ribs 25 should be provided. Preferably 5 cross ribs 25 are provided on each side as illustrated. One pair of cross ribs 25 is located midway between the ends of the cover portion 16, and the other cross ribs 25 are then spaced at center to center distances of from about 10 to 14 inches.

The concave shape of the top 17 also provides strength for the cover portion 16. The sides and end walls slant outwardly from the top edges thereof to the flange 20 at the bottom edges which also provides strength for the cover portion 16. A hand grip 26 is advantageously formed in the elongate rib at the opposite ends of the cover portion 16 for manual manipulation thereof.

As mentioned hereinbefore, the base unit 10 and the cover portion 16 are made so that the structural components thereof are formed integrally with each other. This is advantageously accomplished by injection molding of the base unit 10 and cover portion from plastic materials, such as the so called thermoplastics, which are amenable to injection molding techniques. The base unit 10 and cover portion 16 can also be formed by casting the units on appropriate molds from plastic materials amenable to such casting techniques. Using the latter procedure, vaults can be formed in accordance with this invention from reinforced resin systems such as are commonly called fiberglass.

As will be appreciated, the vault is designed so that the casket is positioned therein and the vault is completely assembled above the ground. The base of the vault is placed in position over the open grave resting upon the webbing of the lowering device so that the webbing lies in the indentations between troughs 13. The casket is placed on the vault base and rests on the top of base units 10. The dome-like cover portion of the vault is then placed over the casket so that the flange 20 seats on ledge 12, with these two parts being separated by a water tight gasket 23. Screws are then inserted into pre-drilled holes in the flange and ledge to secure the base to the cover and to affect a water-tight seal. The screws do not penetrate or damage the gasket, but are placed to the outside edge of the gasket. The total unit is then lowered into the grave. After the unit comes to rest on the ground at the bottom of the grave, the webbing is freed from under the unit as it slips easily through the clearance areas caused by the troughs 13.

Although a preferred embodiment of the invention has been herein illustrated and described, it is to be understood that the present disclosure is made by way of example and that variations are possible without departing from the subject matter coming within the scope of the following claims, which subject matter is regarded as the invention.

I claim:

1. A lightweight, sealed burial vault made of plastic comprising:

a substantially rectangular base unit forming the floor of said vault, said base unit having an outwardly extending ledge around its perimeter;

a dome-like cover portion having a concave top integrally formed to the upper edges of upstanding side and end walls, said side and end walls also being integrally formed together at their junctions;

a flange extending outwardly from the bottom edge perimeter of the end said side walls, and flange being formed integrally to the bottom edges of the end and side walls of said cover portion, wherein the flange mates with the ledge on the base unit when the dome-like cover portion is positioned on the base unit;

means for sealing the flange on said cover portion to the ledge on said base unit;

an elongate rib extending longitudinally along the longitudinal center line of the top of said cover portion and downwardly along the opposite end walls, said longitudinal rib being formed integrally to the top and end walls of the cover portion; and a plurality of spaced, cross ribs extending upwardly along the side walls and then along the top of said cover portion to join said elongate rib, said cross ribs being formed integrally to the side walls and top of the cover portion with the upper ends of said cross ribs further being integrally formed to the side edges of said elongate rib.

2. A burial vault in accordance with claim 1, wherein a downwardly extending lip is provided on the outward perimeter of said flange, with said lip adapted to cover the outer edges of said ledge when the top portion is in position on the base unit.

3. A burial vault in accordance with claim 1, wherein the means for sealing the flange on the cover portion to the ledge on the base unit comprises a waterproof gasket positioned between the flange and the ledge and attachment means for securely holding the flange and ledge together.

4. A burial vault in accordance with claim 1, wherein the base unit has a plurality of spaced apart troughs extending thereacross.

5. A burial vault in accordance with claim 1, wherein the elongate rib member and the cross rib members project from the outer surfaces of said cover portion.

* * * * *